US005664776A

United States Patent [19]

Mateer

[11] Patent Number: 5,664,776

[45] Date of Patent: Sep. 9, 1997

[54] ROLLING HOOP GAME

[76] Inventor: Raymond J. Mateer, 30900 Nye Ct., Livonia, Mich. 48154

[21] Appl. No.: 745,695

[22] Filed: Nov. 12, 1996

[51] Int. Cl.[6] ..... A63B 67/00

[52] U.S. Cl. ..... 273/126 R

[58] Field of Search ..... 273/126 R, 126 A, 273/127 R, 127 C, 127 D

[56] References Cited

U.S. PATENT DOCUMENTS

| | | | |
|---|---|---|---|
| 1,551,981 | 9/1925 | Dette | 273/126 R |
| 4,257,603 | 3/1981 | Harding | 273/126 R |
| 4,616,830 | 10/1986 | Moore | 273/126 R |
| 5,199,708 | 4/1993 | Lucas | 273/126 R |
| 5,377,974 | 1/1995 | Rodriguez Rivera | 273/126 R |

*Primary Examiner*—William H. Grieb
*Attorney, Agent, or Firm*—Robert G. Mentag

[57] ABSTRACT

A rolling hoop game apparatus and a method of playing the game. The game comprises a target having a flat front bankboard surface. The target is hingedly mounted on a support frame that is placed on a longitudinally extending playing surface a predetermined distance from a player stance position on the playing surface. A player standing at the player stance position rolls a hoop linearly with back spin on the playing surface toward the target so as to hit the target and rebound toward the player stance position to be caught by the player at the player stance position to score a game point toward a predetermined number of points to win a game.

1 Claim, 3 Drawing Sheets

ROLLING HOOP GAME

BACKGROUND OF THE INVENTION

1. Field of the Invention

The field of art to which this invention pertains may be generally located in the class of devices relating to games.

2. Description of the Prior Art

Prior art game devices rely on many different playing elements and targets for playing a game, see for example U.S. Pat. Nos. 4,257,603, 4,616,830, 5,199,708 and 5,377,974.

U.S. Pat. No. 4,257,603 discloses a hoop and adjustable target game to be played on a table tennis type table.

U.S. Pat. No. 4,616,830 discloses a rolling hoop game which includes the use of a guiding shaft with a U-shaped hook to roll a hoop.

U.S. Pat. No. 5,199,708 discloses a lawn roller game apparatus and method, wherein ring elements are rolled on the lawn playing surface toward a pair of posts. Points are scored based on closeness of the rings to the playing posts.

U.S. Pat. No. 5,377,974 discloses a hoop balancing game wherein a hoop is rolled across a stretched string in an attempt to balance the hoop as it travels from one end of the string to an opposite end of the string. A concave groove is formed on the periphery of the hoop so as to engage the string as the hoop is rolled across the string.

SUMMARY OF THE INVENTION

A rolling hoop exercise game comprising a longitudinally extending playing surface, defined between a vertical target hingedly mounted on a support frame disposed on the playing surface, and a player stance position. The game is played using a hoop that is rolled linearly with back spin from the player stance position along the playing surface toward the target so as to hit the target and rebound toward the player stance position to be caught by a player standing at the player stance position to score a game point. If the target is knocked down to a horizontal position by the impact force exerted on the target by the hoop the player loses all of his accumulated game points.

DESCRIPTION OF THE PREFERRED EMBODIMENT

Figure 1:
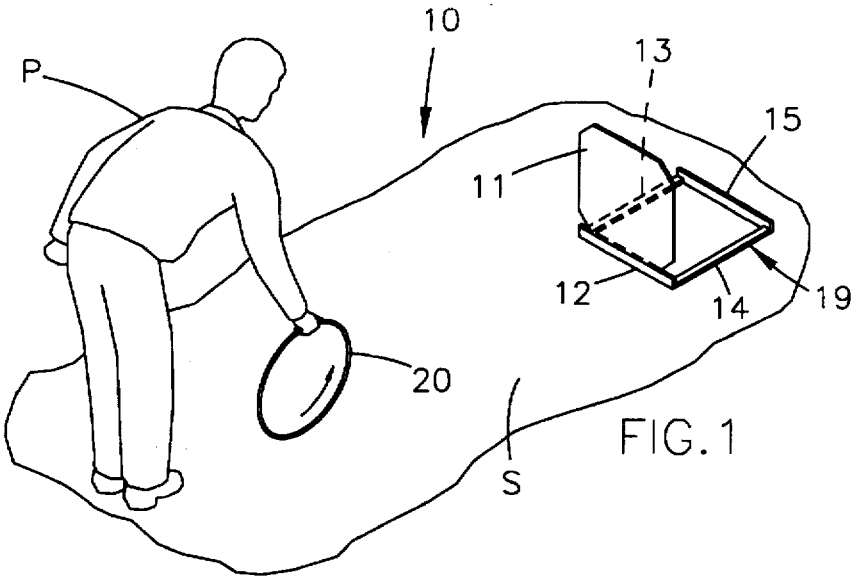
FIG. 1 is a perspective view of the preferred form of the invention and a demonstration of how an initial stage of the game is played on a playing surface.
Figure 2:
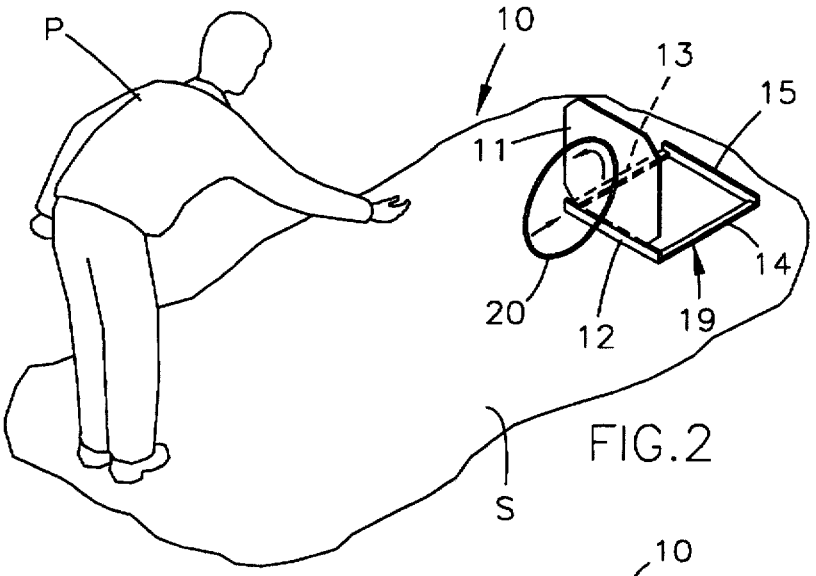
FIG. 2 is a perspective view, similar to FIG. 1 and showing a second stage in the playing of the game.
Figure 3:
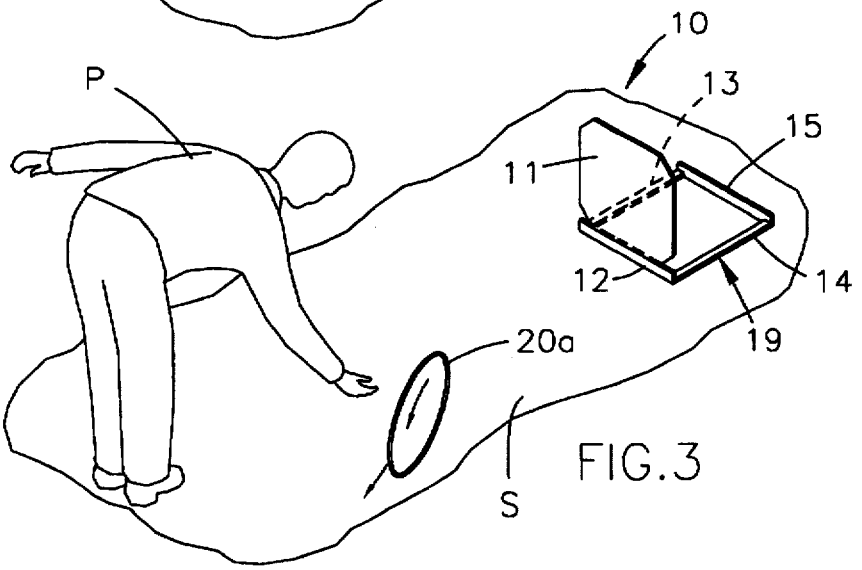
FIG. 3 is a perspective view, similar to FIGS. 1 and 2, and showing a third and final stage in the play of the game.
Figure 4:
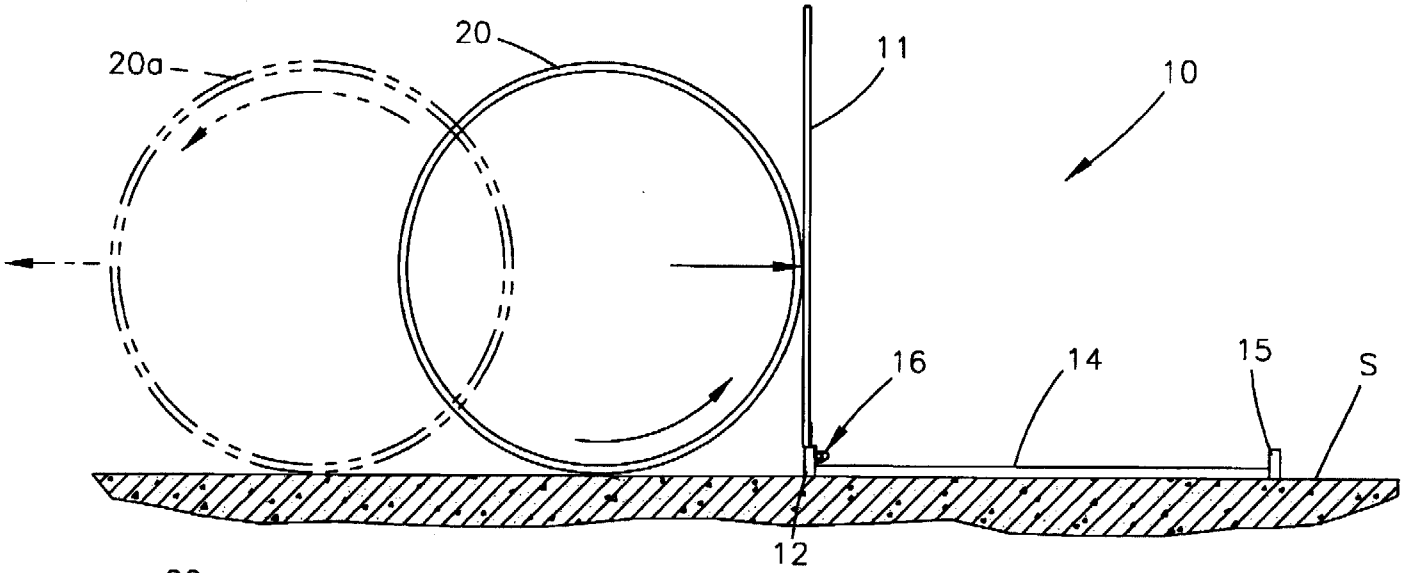
FIG. 4 is a side elevation view of a game target, showing a game hoop engaging the target and returning to a player.

Referring to the drawings, and in particular to FIG. 1, a rolling hoop game, generally indicated by the numeral 10, illustrated by a player "P" making an initial play action on a playing surface "S". The playing surface "S" should be a substantial level surface, such as a level portion of a lawn, a driveway surface, a carpeted surface or some other inside building surface. The rolling hoop game includes a target or bankboard 11 which is hingedly mounted on the front end of a substantially square support frame, generally indicated by the numeral 19. As shown in FIGS. 1–3, the support frame 19 includes a front end transverse rail 12, a left side longitudinal rail 13, a right side longitudinal rail 14, and a rear end transverse rail 15. The rails 12–15 may be made from any suitable material, such as wood, plastic or metal, and they are fixedly secured together by any suitable means, as by nails, screws or an adhesive.

Figure 6:
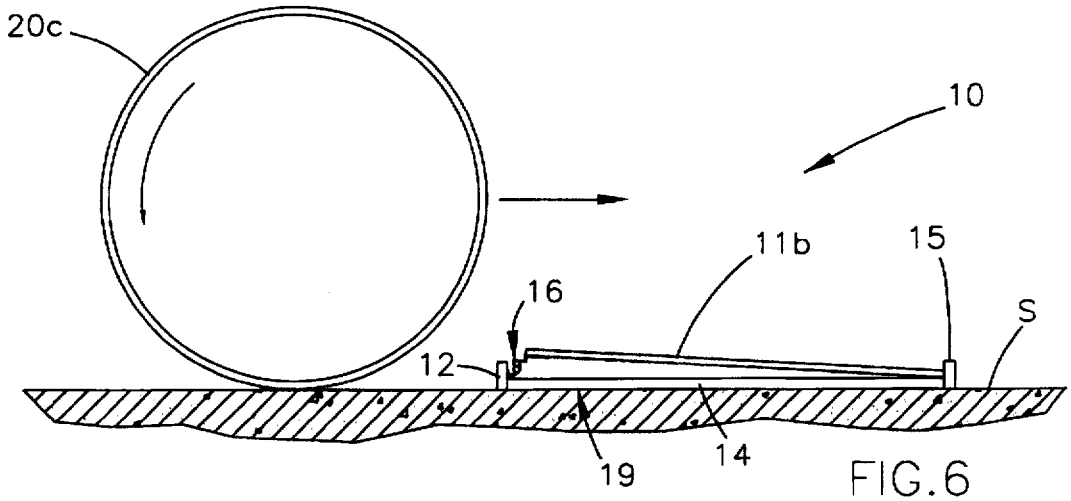
FIG. 6 is a side elevation view of a game target, and showing the target knocked flat by a game hoop.
Figure 7:
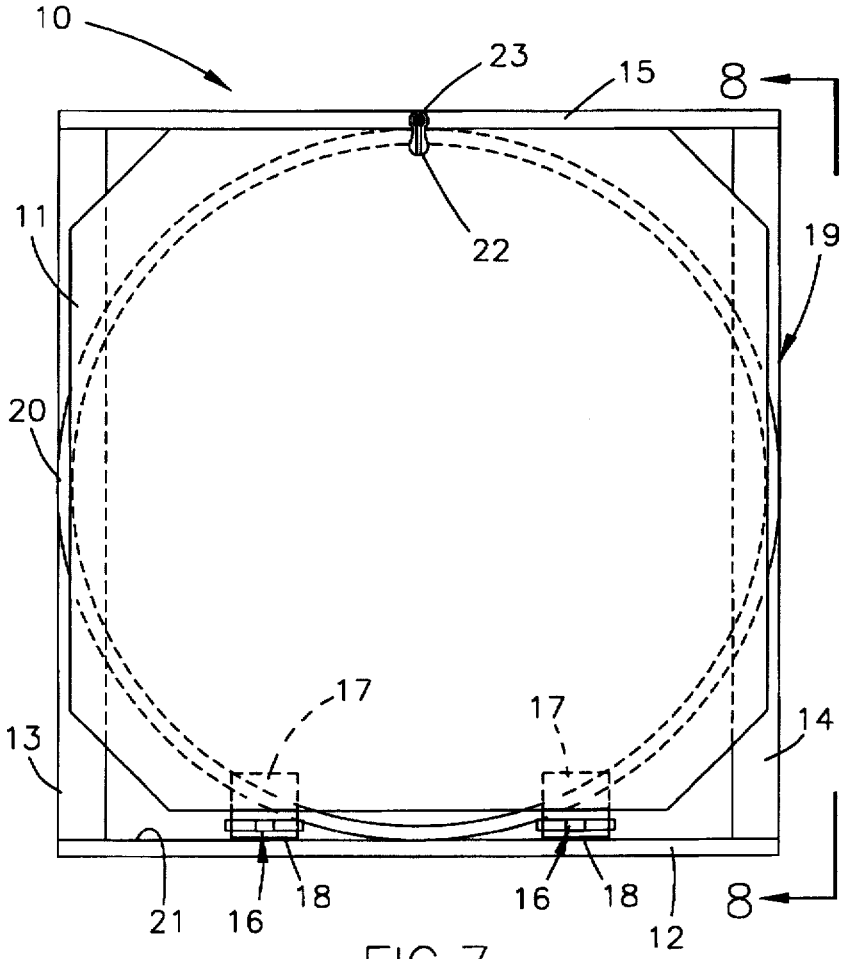
FIG. 7 is a front elevation view of the target and a support frame in a collapsed position, with a game hoop nested between the target and the frame, and with the target releasably secured to the support frame to hold the hoop in between the support frame and the target, to provide a convenient carrying case for a game hoop and support frame.
Figure 8:
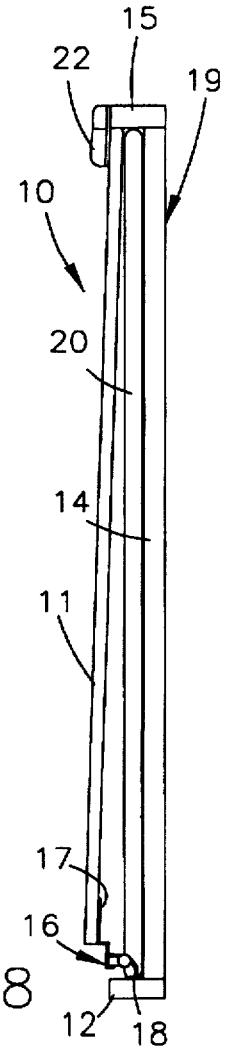
FIG. 8 is a side elevation view of the hoop and support frame illustrated in FIG. 7, taken along the line 8—8 thereof, and looking in the direction of the arrows.

The target or bankboard 11 is hingedly mounted on the front end transverse rail 12 by a pair of suitable spring hinges, generally designated by the numeral 16 in FIGS. 6, 7 and 8. As illustrated in FIGS. 7 and 8, an upper plate portion 17 of each of the spring hinges 16 is fixedly secured to the lower rear side of the target 11, by any suitable means, as by screws, an adhesive, or other securing means. A lower plate portion 18 of each of the hinges 16 is also fixedly secured to the vertical inside surface 21 of the support frame front end transverse rail 12 by any suitable means, as by screws, an adhesive, or other securing means. The spring hinges 16 may be of any suitable type, as for example, the type of spring hinges used on kitchen cabinet doors. In one embodiment the target or bankboard 11 was made with a flat front bankboard surface that was approximately 24 inches high, 26 inches wide, and 3/16 of an inch thick. The target or bankboard may be made from any suitable material, such as wood, plastic or a lightweight metal.

The numeral 20 in FIGS. 1 and 2, designates a game hoop which is preferably made to a diameter of approximately 20 inches so that a player must bend over and reach down to catch a hoop 20 when it rebounds from the target or bankboard 11. The hoop 20 is made preferably from a suitable tubular plastic material having a cross section of about ¾ of an inch. However, it will be understood that the hoop 20 may also be made from a suitable lightweight metal, wood or other stiff material.

When the game is not in use and is to be stored, or transported to a new location, the hoop 20 may be laid against the front of the support frame 19, and the target or bankboard 11 moved downwardly against the hoop 20 to hold the hoop in a nested carrying position, as shown in FIGS. 7 and 8. The target or bankboard 11 may be releasably secured in a convenient carrying case position, as shown in FIGS. 7 and 8, by a retainer lever 22 which is pivotally mounted by a suitable pivot member 23, such as a screw or bolt, in a middle position on the top of the rear end rail 15. Other suitable securing means may be employed to hold the hoop 20 in the position shown in FIGS. 7 and 8, as for example a releasable "VELCRO" strap.

The present game is an exercise game which can be played by two or more persons on an indoor or outdoor playing surface "S". The game is initiated by setting the support frame 19 in a selected position on the surface "S", and with the target or bankboard 11 swung upwardly 90 degrees to a vertical position, as shown in FIGS. 1–3. The game is played by two or more persons taking successive turns. Each player must stand at a predetermined agreed upon distance from the target or bankboard 11, and the player must keep his feet close together, as illustrated in FIG. 1. Beginning players and children should preferably stand approximately 8 feet from the target or bankboard 11, while advanced or experienced players should stand approximately 15 feet from the target or bankboard 11. It will be understood, that the greater the distance the players stand from the target or bankboard 11, the more difficult the play of the game becomes.

Figure 5:
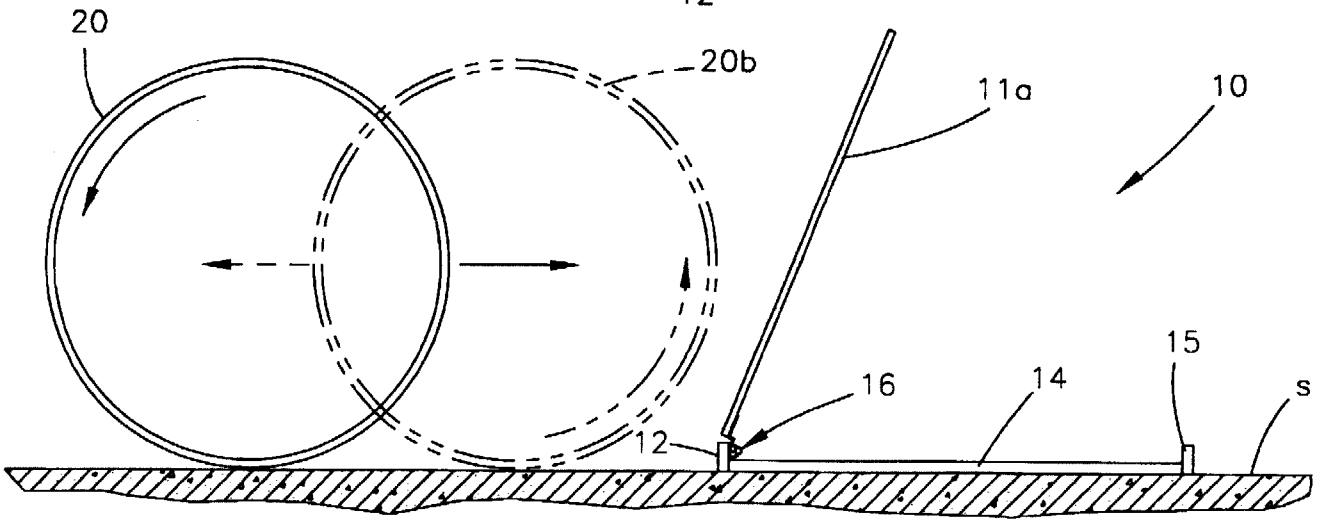
FIG. 5 is a side elevation view of a game target, similar to FIG. 4, but showing the target being partially moved to a leaning position by a game hoop and returning to a player.

After a player positions his body in a position as shown in FIG. 1, he grips a hoop 20 and rolls it forward with backspin toward the target or bankboard 11, so as to hit it, as illustrated in FIG. 2. The back spin on the hoop 20 will cause the hoop 20 to return to the player, as shown in FIG. 3, who must catch the hoop 20*a* with either hand, as illustrated in FIG. 3. A player must catch a returning hoop 20 without moving his feet. Each catch of a hoop 20 counts for one point. The first player to reach 21 points, or any other agreed upon total points, is the winner of the game. If a player misses a returning hoop 20, the player's turn is over and the next player takes his turn. As illustrated in FIG. 5, if a hoop 20 hits the target or bankboard 11, and moves it to an inclined position or angle, indicated by the numeral 11*a* and the target or bankboard holds the inclined position and the hoop 20*b* returns to the player, the fact that the bankboard 11*a* is moved to an angled position does not make the player lose his point if he catches the returning hoop 20. However, as illustrated in FIG. 6, if a player throws a hoop 20*c*, and the hoop 20*c* knocks the target or bankboard down to a horizontal position indicated by the numeral 11*b*, the player loses his turn, and all points accumulated up to that time.

It will be obvious to those skilled in the art that various changes and modifications may be made in playing the exercise game disclosed herein without departing from the spirit of the invention.

What is claimed is:

1. A rolling hoop exercise game (10) comprising:

(a) a longitudinally extending playing surface (S);

(b) a target (11) disposed on the playing surface (S) in a vertical position and having a flat front bankboard surface;

(c) said game including a hoop (20), adapted to be gripped by a player (P) standing in a fixed position, at a predetermined distance from the target (11), and rolled linearly with back spin along the playing surface (S) toward the target (11) to hit the target (11) and rebound toward the player (P) to be caught by the player (P) without moving his feet and score a game point toward a predetermined number of points necessary to win the game; and, (d) said target (11) is hingedly mounted on a support frame (19) to permit the target (11) to be swung rearwardly and downwardly from the vertical position to a different position in accordance with the rearwardly directed impact force exerted on the target (11) by a rolling hoop (20) hitting the target (11).

* * * * *